US010848880B2

(12) United States Patent
De Vries et al.

(10) Patent No.: US 10,848,880 B2
(45) Date of Patent: Nov. 24, 2020

(54) HEARING DEVICE WITH ADAPTIVE SUB-BAND BEAMFORMING AND RELATED METHOD

(71) Applicant: GN HEARING A/S, Ballerup (DK)

(72) Inventors: Rob De Vries, Tilburg (NL); Changxue Ma, Barrington, IL (US); Andrew Dittberner, Andover, MN (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/709,852

(22) Filed: Dec. 10, 2019

(65) Prior Publication Data

US 2020/0112803 A1 Apr. 9, 2020

Related U.S. Application Data

(63) Continuation of application No. 15/880,334, filed on Jan. 25, 2018, now Pat. No. 10,555,094.

(60) Provisional application No. 62/478,445, filed on Mar. 29, 2017.

(51) Int. Cl.
*H04R 25/00* (2006.01)

(52) U.S. Cl.
CPC ..... *H04R 25/552* (2013.01); *H04R 25/407* (2013.01); *H04R 25/554* (2013.01); *H04R 25/558* (2013.01); *H04R 2225/43* (2013.01); *H04R 2430/20* (2013.01)

(58) Field of Classification Search
CPC .. H04R 25/552; H04R 25/554; H04R 25/558; H04R 25/407; H04R 25/405; H04R 2430/20; H04R 2225/43; H04R 2225/41; H04R 3/005
See application file for complete search history.

(56) References Cited

U.S. PATENT DOCUMENTS

2002/0041695 A1* 4/2002 Luo ..... H04R 25/552 381/313
2009/0238385 A1* 9/2009 Fischer ..... H04R 25/552 381/312
2013/0010972 A1* 1/2013 Ma ..... H04R 25/356 381/23.1

(Continued)

*Primary Examiner* — Yogeshkumar Patel
(74) *Attorney, Agent, or Firm* — Vista IP Law Group, LLP

(57) ABSTRACT

A hearing device for a binaural hearing system comprising the hearing device and a contralateral hearing device, comprising: a transceiver module for obtaining a contralateral filtered beamform signal from the contralateral hearing device; microphones for provision of a first and second microphone input signals; a first beamforming module for provision of a first beamform signal based on the first and second microphone input signals; a filter bank, connected to the first beamforming module, for filtering the first beamform signal into a plurality of filtered beamform signals including a first bandpass beamform signal; a bandpass beamformer coupled to the filter bank; an adder, connected to the bandpass beamformer, for provision of a beamformed input signal; a processing circuit for processing the beamformed input signal and providing an electrical output signal based on the beamformed input signal; and a receiver for converting the electrical output signal to an audio output signal.

28 Claims, 5 Drawing Sheets

(56) References Cited

U.S. PATENT DOCUMENTS

| | | | | |
|---|---|---|---|---|
| 2013/0010973 | A1* | 1/2013 | Ma | H04R 25/356 381/23.1 |
| 2013/0156202 | A1* | 6/2013 | Hamacher | H04R 25/552 381/23.1 |
| 2013/0170680 | A1* | 7/2013 | Gran | H04R 25/405 381/313 |
| 2013/0259239 | A1* | 10/2013 | Aubreville | H04R 25/405 381/23.1 |
| 2014/0010373 | A1* | 1/2014 | Gran | H04R 25/353 381/23.1 |
| 2015/0249892 | A1* | 9/2015 | Kuhnel | H04R 25/552 381/315 |
| 2015/0289065 | A1* | 10/2015 | Jensen | H04R 25/405 381/315 |
| 2016/0066104 | A1* | 3/2016 | Minnaar | H04R 25/552 381/23.1 |
| 2016/0219365 | A1* | 7/2016 | Elko | H04R 1/326 |
| 2017/0105074 | A1* | 4/2017 | Jensen | H04R 25/407 |
| 2017/0332182 | A1* | 11/2017 | Minnaar | H04R 25/407 |
| 2017/0345439 | A1* | 11/2017 | Jensen | H04R 25/505 |
| 2018/0041849 | A1* | 2/2018 | Farmani | H04R 25/554 |
| 2018/0098160 | A1* | 4/2018 | Jensen | H04R 25/554 |
| 2018/0192209 | A1* | 7/2018 | Chen | H04R 25/453 |
| 2018/0234777 | A1* | 8/2018 | Roeck | H04L 1/0001 |
| 2018/0262847 | A1* | 9/2018 | Pedersen | H04R 25/405 |
| 2018/0262849 | A1* | 9/2018 | Farmani | H04R 25/552 |
| 2019/0246220 | A1* | 8/2019 | Chen | H04R 25/604 |

* cited by examiner

HEARING DEVICE WITH ADAPTIVE SUB-BAND BEAMFORMING AND RELATED METHOD

RELATED APPLICATION DATA

This application is a continuation of U.S. patent application Ser. No. 15/880,334, filed on Jan. 25, 2018, pending, which claims priority to, and the benefit of, U.S. Provisional Patent Application No. 62/478,445, filed on Mar. 29, 2017, now lapsed. The entire disclosures of the above applications are expressly incorporated by reference herein.

FIELD

The present disclosure relates to a hearing device with adaptive binaural auditory steering and a method of operating a hearing device in a binaural hearing system.

BACKGROUND

In acoustic environments, it is natural for a normal listener to focus on one talker while monitoring other acoustic sources. An example hereof is other talkers in a cocktail party setting or other complex acoustic environments. In this regard, the acoustic filtering due to the head shadow effect and the binaural neural interaction plays an important part to enhance the speech of the focused talker while suppressing other interference. Moreover, the brain also forms another sound image from two ears to monitor the other acoustic sources, which are suppressed by the binaural beamforming effects.

US 2015/0289065 A1 relates to a binaural hearing assistance system comprising binaural noise reduction. The user can input the location of the target sound source, e.g. with a remote control or cellular phone, and a noise reduction system operates based on the inputted location.

When people wear hearing aids, the signals from the acoustic sources are spatially filtered by an extra stage, i.e. hearing aids, especially when the hearing aids apply higher order beamforming technologies to enhance the directivities.

SUMMARY

Accordingly, there is a need for devices and methods to enhance the speech in noisy environments and cocktail party scenarios.

A hearing device for a binaural hearing system comprising the hearing device and a contralateral hearing device is disclosed. The hearing device comprises a transceiver module for communication with a contralateral hearing device of the binaural hearing system, the transceiver module configured for provision of a contralateral beamform signal received from the contralateral hearing device; a set of microphones comprising a first microphone for provision of a first microphone input signal, and a second microphone for provision of a second microphone input signal; a first beamforming module, connected to the set of microphones, for provision of a first beamform signal based on the first microphone input signal and the second microphone input signal; a filter bank, connected to the first beamforming module and optionally the transceiver module, for filtering the first beamform signal into a plurality of first sub-band beamform signals including a first bandpass beamform signal, and optionally for filtering the contralateral beamform signal into a contralateral bandpass beamform signal; a second beamforming module connected to the filter bank, the second beamforming module comprising a bandpass beamformer for provision of a second bandpass beamform signal based on the first bandpass beamform signal and/or the contralateral bandpass beamform signal; an adder, connected to the bandpass beamformer, for provision of a beamformed input signal based on the second bandpass beamform signal; a processor for processing the beamformed input signal and providing an electrical output signal based on the beamformed input signal; and a receiver for converting the electrical output signal to an audio output signal. The bandpass beamformer of the second beamforming module is optionally an adaptive beamformer.

Also disclosed is a binaural hearing system comprising a hearing device and a contralateral hearing device, wherein the hearing device is a hearing device as disclosed herein. The contralateral hearing device may be a hearing device as disclosed herein.

A method of operating a hearing device in a binaural hearing system comprising the hearing device and a contralateral hearing device is disclosed, the method comprising obtaining a contralateral beamform signal from the contralateral hearing device; obtaining a first microphone input signal and a second microphone input signal; providing a first beamform signal based on the first microphone input signal and the second microphone input signal; filtering the first beamform signal and optionally the contralateral beamform signal to provide a first bandpass beamform signal and a contralateral bandpass beamform signal; providing a second bandpass beamform signal based on the first bandpass beamform signal and/or the contralateral bandpass beamform signal; providing a beamformed input signal based on the second bandpass beamform signal; performing hearing compensation processing on the beamformed input signal to provide an electrical output signal; and converting the electrical output signal to an audio output signal. In the method, providing a second bandpass beamform signal optionally comprises applying adaptive beamforming to the first bandpass beamform signal and the contralateral bandpass beamform signal.

The present devices and methods provide improved binaural auditory steering strategy (BASS) for integrating acoustic, auditory processing and selective listening mechanisms. The present devices and methods form a highly focused directional microphone beam for the attended talker and at the same time forms a receiving pattern similar to omni microphone characteristic for other talkers on the side.

The present disclosure integrates acoustical filtering, peripheral processing and central listening level to provide an improved hearing device solution.

The present disclosure provides an optimized beamforming to accommodate both selective/targeted listening and situational awareness.

A hearing device for a binaural hearing system comprising the hearing device and a contralateral hearing device, the hearing device includes: a transceiver module for communication with a contralateral hearing device of the binaural hearing system, the transceiver module configured to obtain a contralateral beamform signal from the contralateral hearing device; a set of microphones comprising a first microphone for provision of a first microphone input signal, and a second microphone for provision of a second microphone input signal; a first beamforming module, connected to the set of microphones, for provision of a first beamform signal based on the first microphone input signal and the second microphone input signal; a filter bank, connected to the first beamforming module and the transceiver module, for filtering the first beamform signal into a plurality of first sub-band beamform signals including a first bandpass beamform signal, and for filtering the contralateral beamform signal into a contralateral bandpass beamform signal; a second beamforming module connected to the filter bank, the second beamforming module comprising a bandpass beamformer for provision of a second bandpass beamform signal based on the first bandpass beamform signal and the contralateral bandpass beamform signal; an adder, connected to the bandpass beamformer, for provision of a beamformed input signal based on the second bandpass beamform signal; a processor for processing the beamformed input signal and providing an electrical output signal based on the beamformed input signal; and a receiver for converting the electrical output signal to an audio output signal, wherein the bandpass beamformer of the second beamforming module is an adaptive beamformer. By means of non-limiting examples, the second bandpass beamform signal may be a low-pass beamform signal and/or a high-pass beamform signal.

Optionally, the bandpass beamformer comprises a bandpass beamform controller and a first multiplier, wherein the bandpass beamformer is configured to determine a first bandpass coefficient for the first bandpass beamform signal based on the first bandpass beamform signal and the contralateral bandpass beamform signal, and to apply the first bandpass coefficient in the first multiplier.

Optionally, the bandpass beamformer is configured to determine the first bandpass coefficient for the first bandpass beamform signal by solving a minimization problem based on expected power values of the first bandpass beamform signal and the contralateral bandpass beamform signal.

Optionally, the bandpass beamformer is configured to determine the first bandpass coefficient for the first bandpass beamform signal by solving a minimization problem based on an expected mean square value of a linear combination of the first bandpass beamform signal and the contralateral bandpass beamform signal.

Optionally, the bandpass beamformer comprises a contralateral multiplier, and wherein the bandpass beamform controller is configured to determine a contralateral bandpass coefficient for the contralateral bandpass beamform signal based on the first bandpass beamform signal and the contralateral bandpass beamform signal, and to apply the contralateral bandpass coefficient in the contralateral multiplier.

Optionally, the bandpass beamform controller is configured to determine the contralateral bandpass coefficient for the contralateral bandpass beamform signal by solving a minimization problem based on expected power values of the first bandpass beamform signal and the contralateral bandpass beamform signal.

Optionally, the bandpass beamform controller is configured to determine the contralateral bandpass coefficient for the contralateral bandpass beamform signal by solving a minimization problem based on an expected mean square value of a linear combination of the first bandpass beamform signal and the contralateral bandpass beamform signal.

Optionally, the bandpass beamformer comprises a bandpass equalizer configured to provide the second bandpass beamform signal based on an equalizer input, wherein the equalizer input is based on the first bandpass beamform signal and/or the contralateral bandpass beamform signal.

Optionally, the second beamforming module comprises a low-pass beamformer for provision of a second low-pass beamform signal based on a first low-pass beamform signal and also based on a contralateral low-pass beamform signal, and wherein the adder is connected to the low-pass beamformer for provision of the beamformed input signal based on the second low-pass beamform signal.

Optionally, the second beamforming module comprises a high-pass beamformer for provision of a second high-pass beamform signal based on a first high-pass beamform signal and also based on a contralateral high-pass beamform signal, and wherein the adder is connected to the high-pass beamformer for provision of the beamformed input signal based on the second high-pass beamform signal.

Optionally, the hearing device comprises a beamform controller connected to the second beamforming module for controlling the second beamforming module, wherein the beamforming controller is configured to apply, in the second beamforming module, a second primary beamforming scheme in a primary operating mode of the hearing device, and to apply, in the second beamforming module, a second secondary beamforming scheme in a secondary operating mode of the hearing device.

Optionally, the beamform controller is connected to the first beamforming module for controlling the first beamforming module, wherein the beamforming controller is configured to apply, in the first beamforming module, a first primary beamforming scheme in the primary operating mode of the hearing device, and to apply a first secondary beamforming scheme in the secondary operating mode of the hearing device.

Optionally, the first beamforming module is connected to the transceiver module, and wherein the transceiver module is configured for transmitting at least a part of the first beamform signal to the contralateral hearing device.

A binaural hearing system includes any of the hearing device described herein, and a contralateral hearing device.

A method of operating a hearing device in a binaural hearing system comprising the hearing device and a contralateral hearing device, the method includes: obtaining a contralateral beamform signal from the contralateral hearing device; obtaining a first microphone input signal and a second microphone input signal; providing a first beamform signal based on the first microphone input signal and the second microphone input signal; filtering the first beamform signal and the contralateral beamform signal to provide a first bandpass beamform signal and a contralateral bandpass beamform signal; providing a second bandpass beamform signal based on the first bandpass beamform signal and the contralateral bandpass beamform signal; providing a beamformed input signal based on the second bandpass beamform signal; performing hearing compensation processing on the beamformed input signal to provide an electrical output signal; and converting the electrical output signal to an audio output signal; wherein the act of providing the second bandpass beamform signal comprises applying adaptive beamforming to the first bandpass beamform signal and the contralateral bandpass beamform signal.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
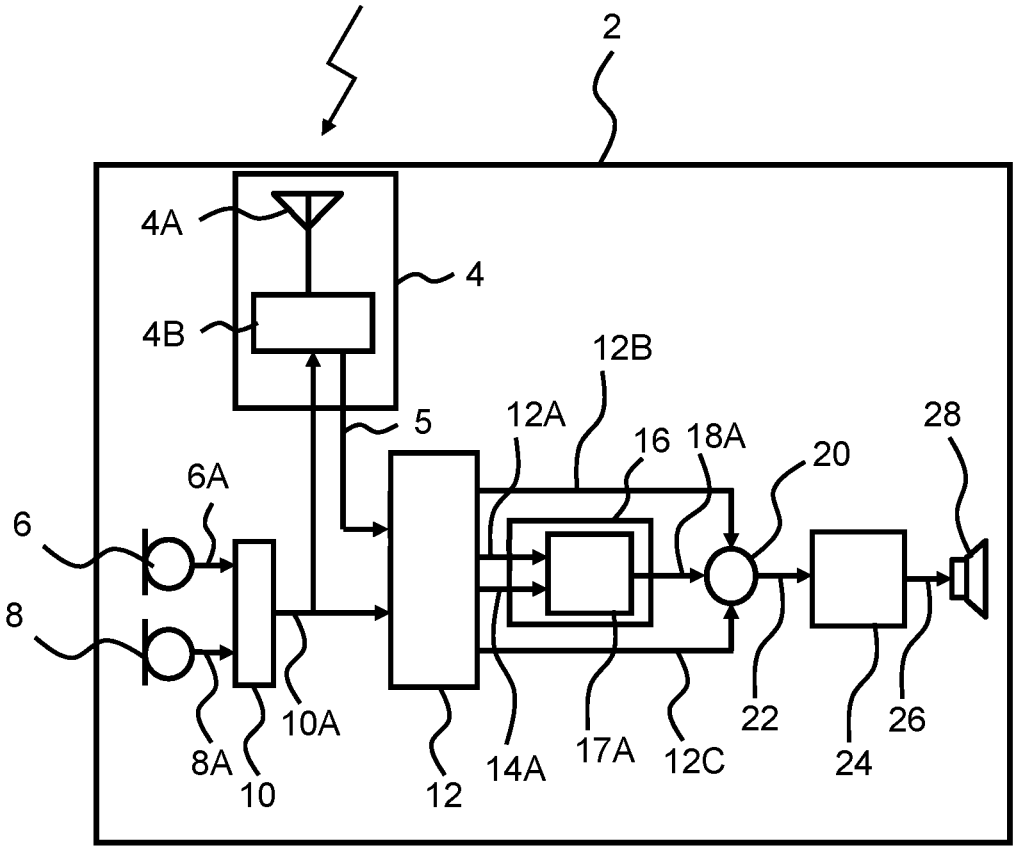
FIG. 1 schematically illustrates an exemplary hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The disclosed hearing devices and methods provide improved spatial unmasking for both ears of a user together with improved off-axis listening. Further, better situational awareness to provide multiple streams for selective listening is provided. The present disclosure provides an asymmetric listening experience by taking advantages of binaural hearing mechanism of the human auditory system. Thus, asymmetric, and different polar patterns, i.e. focused polar pattern and the monitor polar pattern, are applied in the two hearing devices of the binaural hearing system. The focused polar pattern is optionally designed to deal with the diffuse noise, and the monitor polar pattern is optionally designed together with the focused polar pattern to provide optimized situational awareness and better speech intelligibility, e.g. utilizing the selective attention mechanism of the auditory system. The disclosed hearing devices and methods involve design of the focused ear and monitored ear spatial filtering system to satisfy the needs of a human listener.

The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. The hearing aid may be a binaural hearing aid.

The hearing device comprises a transceiver module for communication (receive and/or transmit) with a contralateral hearing device of the binaural hearing system. The transceiver module is optionally configured for provision of a contralateral beamform signal received from the contralateral hearing device. The transceiver module may comprise an antenna for converting one or more wireless input signals from the contralateral hearing device to an antenna output signal. The transceiver module optionally comprises a radio transceiver coupled to the antenna for converting the antenna output signal to a transceiver input signal. The transceiver module may comprise a plurality of antennas and/or an antenna may be configured to be operate in one or a plurality of antenna modes.

The contralateral beamform signal may be a combination of a plurality of microphone input signals of the contralateral hearing device, thus enabling an effective use of the limited transceiver resources (bandwidth and battery). In one or more exemplary hearing devices or methods, the contralateral beamform signal may be a monitor beamform signal. In one or more exemplary hearing devices or methods, the contralateral beamform signal may be a microphone input signal from the contralateral hearing device.

The hearing device comprises a set of microphones. The set of microphones may comprise one or more microphones. The set of microphones comprises a first microphone for provision of a first microphone input signal and/or a second microphone for provision of a second microphone input signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone input signal.

The hearing device comprises a first beamforming module for provision of a first beamform signal based on the first microphone input signal and/or the second microphone input signal. The first beamforming module is connected to the set of microphones for receiving microphone input signals. The first beamform signal may be based on the third microphone input signal, if present. The first beamforming module may operate in the time-domain.

The hearing device comprises a filter bank, optionally including a plurality of filters, for filtering the first beamform signal into a plurality of first sub-band beamform signals including a first bandpass beamform signal. The filter bank is connected to the first beamforming module for receiving the first beamform signal. The plurality of first sub-band beamform signals may comprise a first low-pass beamform signal and/or a first high-pass beamform signal. The plurality of first sub-band beamform signals may comprise a plurality of first bandpass beamform signals. The filter bank may operate in the time-domain.

The filter bank optionally comprises a first bandpass filter for filtering the first beamform signal into the first bandpass beamform signal. The first bandpass filter may have a lower cut-off frequency in the range from 300 Hz to 2.0 kHz. The first bandpass filter may have a higher cut-off frequency in the range from 4.0 kHz to 8.0 kHz. In one or more exemplary hearing devices, the first bandpass filter has a lower cut-off frequency in the range from 1.0 kHz to 1.8 kHz and a higher cut-off frequency in the range from 5.0 kHz to 7.0 kHz.

The filter bank optionally comprises a contralateral bandpass filter for filtering the contralateral beamform signal into the contralateral bandpass beamform signal. The contralateral bandpass filter may have a lower cut-off frequency in the range from 300 Hz to 2.0 kHz. The contralateral bandpass filter may have a higher cut-off frequency in the range from 4.0 kHz to 8.0 kHz. In one or more exemplary hearing devices, the contralateral bandpass filter has a lower cut-off frequency in the range from 1.0 kHz to 1.8 kHz and a higher cut-off frequency in the range from 5.0 kHz to 7.0 kHz.

The filter bank optionally comprises a first low-pass filter for filtering the first beamform signal into the first low-pass beamform signal. The first low-pass filter may have a cut-off frequency in the range from 300 Hz to 2.0 kHz. In one or more exemplary hearing devices, the first low-pass filter has a cut-off frequency in the range from 1.0 kHz to 1.8 kHz. The first low-pass filter may be implemented as a bandpass filter with a lower cut-off frequency in the range from 0 Hz to 300 Hz and a higher cut-off frequency in the range from 1.0 kHz to 1.8 kHz.

The filter bank optionally comprises a first high-pass filter for filtering the first beamform signal into the first high-pass beamform signal. The first high-pass filter may have a cut-off frequency larger than 4.0 kHz, such as in the range from 5.0 kHz to 7.0 kHz. In one or more exemplary hearing devices, the first high-pass filter may be implemented as a bandpass filter with a lower cut-off frequency in the range from 5.0 kHz to 7.0 kHz and a higher cut-off frequency larger than 8 kHz, such as in the range from 8.0 kHz to 12 kHz.

The filter bank is optionally connected to the transceiver module for receiving and/or filtering the contralateral beamform signal into at least a contralateral bandpass beamform signal. The filter bank may be configured for filtering the contralateral beamform signal into a plurality of contralateral sub-band beamform signals including a contralateral bandpass beamform signal. The plurality of contralateral sub-band beamform signals may include a contralateral low-pass beamform signal and/or a contralateral high-pass beamform signal.

The filter bank optionally comprises a contralateral low-pass filter for filtering the contralateral beamform signal into the contralateral low-pass beamform signal. The contralateral low-pass filter may have a cut-off frequency in the range from 300 Hz to 2.0 kHz. In one or more exemplary hearing devices, the contralateral low-pass filter has a cut-off frequency in the range from 1.0 kHz to 1.8 kHz. The contralateral low-pass filter may be implemented as a bandpass filter with a lower cut-off frequency in the range from 0 Hz to 300 Hz and a higher cut-off frequency in the range from 1.0 kHz to 1.8 kHz.

The filter bank optionally comprises a contralateral high-pass filter for filtering the contralateral beamform signal into the contralateral high-pass beamform signal. The contralateral high-pass filter may have a cut-off frequency larger than 4.0 kHz, such as in the range from 5.0 kHz to 7.0 kHz. In one or more exemplary hearing devices, the contralateral high-pass filter may be implemented as a bandpass filter with a lower cut-off frequency in the range from 5.0 kHz to 7.0 kHz and a higher cut-off frequency larger than 8 kHz, such as in the range from 8.0 kHz to 12 kHz.

It is an important advantage of the present disclosure that noise suppression can be performed in selected sub-bands, while it from a hearing point of view is desired to modify input signals as little as possible to help auditory scene analysis. Further, some frequency regions are more susceptible to noise interference, and the present disclosure allows improving the SNR selectively in these regions.

The hearing device comprises a second beamforming module for provision of one or more second beamform signals, e.g. including a second bandpass beamform signal, based on the first bandpass beamform signal and/or the contralateral bandpass beamform signal. The second beamforming module is connected to the filter bank for receiving first sub-band beamform signal(s) and/or contralateral sub-band beamform signal(s). The second beamforming module may operate in the time-domain.

The second beamforming module comprises one or more beamformers including a bandpass beamformer. The bandpass beamformer may be an adaptive beamformer. An adaptive beamformer is a beamformer where the beamforming is adapted according to one or more input signals to the beamformer.

The second beamforming module may be connected directly to the transceiver module for receiving the contralateral beamform signal(s). Thus, the contralateral beamform signal may be a contralateral bandpass beamform signal, e.g. due to encoding/decoding in the transceiver module and/or filtering prior to transmission from the contralateral hearing device.

The hearing device comprises an adder. The adder is optionally connected to one or more outputs of the second beamforming module, e.g. to the bandpass beamformer, for provision of a beamformed input signal, e.g. based on one or more second beamform signals from the second beamforming module. The beamformed input signal may be based on the second bandpass beamform signal.

The hearing device comprises a processor for processing the beamformed input signal and providing an electrical output signal based on the beamformed input signal. The processor may be configured to compensate for hearing loss of a user, e.g. by filtering and/or compression of the beamformed input signal.

A beamformer of the second beamforming module may comprise a beamform controller and/or one or more multipliers, such as a plurality of multipliers. A beamformer of the second beamforming module optionally comprises an adder connected to the multipliers for adding the multiplier outputs for provision of a respective second beamform signal. The beamform controller is configured to determine and/or apply respective coefficients also denoted A_1, B_1, A_2, B_2, A_3, B_3, A_4, B_4, etc in the one or more multipliers.

The bandpass beamformer may comprise a bandpass beamform controller and a first multiplier, wherein the bandpass beamformer, e.g. the bandpass beamform controller, is optionally configured to determine a first bandpass coefficient for the first bandpass beamform signal based on the first bandpass beamform signal and/or the contralateral bandpass beamform signal. The bandpass beamformer, e.g. the bandpass beamform controller, is optionally configured to apply the first bandpass coefficient in the first multiplier. An adaptive bandpass beamformer in the second beamforming module allows for beamforming in a selected frequency band, e.g. a frequency band covering speech, while allowing e.g. upper and/or lower frequencies to pass with no or highly reduced beamforming. This is highly advantageous since ILD's (Interaural Level Difference) and ITD's (Interaural Time Difference) of the sound input signal typically resides in upper and lower frequency bands.

The present hearing device is based on the time-domain sub-band signals from both ears. The benefit of using time-domain sub-band signals from both ears for bilateral beamforming is clear in term of improving SNR. Further, the present disclosure provides reduced tunnel hearing effects by allowing maintenance of spatial cues and conversation contextual cues.

It is an important advantage of the present disclosure that Signal to Noise-Ratio (SNR) can be improved in selected frequency bands, while leaving other frequency bands unaffected or enabling different beamforming schemes in different frequency bands, e.g. in order to optimize spatial cues (ILD and ITD).

The hearing device, e.g. the bandpass beamform controller, may be configured to determine a first bandpass coefficient also denoted A_1 for the first bandpass beamform signal. For example, to determine a first bandpass coefficient for the first bandpass beamform signal may comprise to solve a minimization problem. The minimization problem may be based on expected power values of the first bandpass beamform signal and/or the contralateral bandpass beamform signal.

The minimization problem may be given by a cost function, optionally under one or more constraints.

In one or more exemplary hearing devices, to determine a first bandpass coefficient for the first bandpass beamform signal may comprise to solve a minimization problem, e.g. based on an expected mean square value of a linear combination of the first bandpass beamform signal and the contralateral bandpass beamform signal.

A beamformer of the second beamforming module may comprise a contralateral multiplier. The beamform controller of a beamformer may be configured to determine a contralateral coefficient for the contralateral multiplier, e.g. based on a first beamform signal and a contralateral beamform signal, and to apply the contralateral coefficient in the contralateral multiplier, e.g. to a contralateral sub-band beamform signal.

In one or more exemplary hearing devices, the bandpass beamformer comprises a contralateral multiplier. The bandpass beamform controller may be configured to determine a contralateral bandpass coefficient also denoted B_1 for the contralateral bandpass beamform signal based on the first bandpass beamform signal and/or the contralateral bandpass beamform signal. The bandpass beamform controller may be configured to apply the contralateral bandpass coefficient in the contralateral multiplier, e.g. to the contralateral bandpass beamform signal.

In one or more exemplary hearing devices, to determine a contralateral bandpass coefficient for the contralateral bandpass beamform signal may comprise to solve a minimization problem, e.g. based on expected power values of the first bandpass beamform signal and/or the contralateral bandpass beamform signal.

In one or more exemplary hearing devices, to determine a contralateral bandpass coefficient for the contralateral bandpass beamform signal may comprise to solve a minimization problem, e.g. based on an expected mean square value of a linear combination of the first bandpass beamform signal and/or the contralateral bandpass beamform signal.

In one or more exemplary hearing devices, the coefficients A_1, B_1, A_2, B_2, A_3, B_3 etc. are in the range from 0 to 1.

For example, to determine a first bandpass coefficient, also denoted $\alpha$ or A_1, for the first bandpass beamform signal and/or a contralateral bandpass coefficient, also denoted $\beta$ or B_1, for the contralateral bandpass beamform signal may comprise to solve a minimization problem, e.g. given by $$s_i=\text{argmax}(\text{SNR}(l_i),\text{SNR}(r_i),\text{SNR}(\alpha l_i+(1-\alpha)r_i),$$

Where $l_i$ is the first bandpass beamform signal, $r_i$ is the contralateral bandpass beamform signal, and $\alpha$ is the first bandpass coefficient. For hearing device designs, we assume that the target sound source is located on the zero-direction axis. The formula above can be simplified as:

$$s_i=\text{argmin}(\text{rms}(l_i),\text{rms}(r_i),\text{rms}(\alpha l_i+(1-\alpha)r_i),$$

where rms represents the root mean square value of the signal. Therefore, it is needed to obtain the optimal a value to achieve our goal. It is equivalent to solving the $\alpha$ and $\beta$ the following cost functions $C(\alpha,\beta)$:

$$\text{argmin}\{E[(\alpha l_i+\beta r_i)\cdot(\alpha l_i+\beta r_i)]\}$$

and under the constraints $\alpha+\beta=1$ and E is statistical expectation, where $\alpha$ is the first bandpass coefficient and $\beta$ is the contralateral bandpass coefficient.

In one or more exemplary hearing devices, to solve a minimization problem may comprise applying a stochastic steepest descent algorithm.

In one or more exemplary hearing devices, to solve a minimization problem may comprise applying a least mean square algorithm or a normalized least mean square algorithm.

The minimization problem may be obtained adaptively, e.g. by:

$$C(\alpha,\beta)=\{E\{(\alpha l_i+\beta r_i)\cdot(\alpha l_i+\beta r_i)\}+\lambda(\alpha+\beta-1)$$

The minimization problem may be solved by using the stochastic steepest descent algorithm comprising:

$$\text{Take Gradient } \nabla C=\begin{pmatrix} 2\alpha E\{l\cdot l)+2\beta E\{l\cdot r\}+\lambda \\ 2\beta E\{r\cdot r)+2\alpha E\{l\cdot r\}+\lambda \end{pmatrix}=2\begin{Bmatrix} E\{v\cdot l\}+\lambda+ \\ E\{v\cdot r\}+\lambda \end{Bmatrix}$$

$$\text{Solve Lagrange } \lambda=-E\{v\cdot l\}-E\{v\cdot r\} \text{ and}$$

$$v=\alpha l+\beta r$$

$$\nabla C=\begin{Bmatrix} E\{v\cdot l\}-E\{v\cdot r\} \\ E\{v\cdot r\}-E\{v\cdot l\} \end{Bmatrix}$$

$$\text{Solution is } \begin{pmatrix} \alpha_{n+1} \\ \beta_{n+1} \end{pmatrix}=\begin{pmatrix} \alpha_n \\ \beta_n \end{pmatrix}-\mu\cdot\begin{Bmatrix} E\{v\cdot l\}-E\{v\cdot r\} \\ E\{v\cdot r\}-E\{v\cdot l\} \end{Bmatrix}$$

$$\mu \text{ is step size}$$

The minimization problem may be solved by using LMS algorithm (least mean square):

$$\begin{pmatrix} \alpha_{n+1} \\ \beta_{n+1} \end{pmatrix}=\begin{pmatrix} \alpha_n \\ \beta_n \end{pmatrix}-\mu\cdot\begin{Bmatrix} \{v\cdot l\}-\{v\cdot r\} \\ \{v\cdot r\}-\{v\cdot l\} \end{Bmatrix}$$

The minimization problem may be solved by using NLMS algorithm(normalized least mean square):

$$\begin{pmatrix} \alpha_{n+1} \\ \beta_{n+1} \end{pmatrix}=\begin{pmatrix} \alpha_n \\ \beta_n \end{pmatrix}-\mu\cdot\begin{Bmatrix} \{v\cdot l\}-\{v\cdot r\} \\ \{v\cdot r\}-\{v\cdot l\} \end{Bmatrix}\Big/\{v\cdot v\} \text{ or}$$

$$\begin{pmatrix} \alpha_{n+1} \\ \beta_{n+1} \end{pmatrix}=\begin{pmatrix} \alpha_n \\ \beta_n \end{pmatrix}-\mu\cdot\begin{Bmatrix} \{v\cdot(l-r)\} \\ \{v\cdot(r-l)\} \end{Bmatrix}\Big/\{v\cdot v\}$$

For all three algorithms, the update is done when $v\cdot v>0$. The implemented solution is as follows:

$$\begin{pmatrix} \alpha_{n+1} \\ \beta_{n+1} \end{pmatrix}=\begin{pmatrix} \alpha_n \\ \beta_n \end{pmatrix}-\mu\cdot\begin{Bmatrix} \{v\cdot(l_i-r_i)\} \\ \{v\cdot(r_i-l_i)\} \end{Bmatrix},$$

where the output is $v=\alpha_n l_i+\beta_n r_i$ and the step size $\mu=0.001$, $\alpha_n$ is the first bandpass coefficient, and $\beta_n$ is the contralateral bandpass coefficient used in the bandpass beamformer.

The size of the beamform signal vectors l and r may be from 20 to 60, e.g. 48 samples at sampling rate from 8 kHz to 33 kHz, e.g. 16 kHz. The beamform signal vectors may be accumulative in two frames in calculation.

In one or more exemplary hearing devices, the better ear strategy (minimization problem) may, e.g. for one or more sub-bands, be expressed as:

$$s_i=\text{argmin}(\text{rms}(l_i),\text{rms}(r_i),\text{rms}(v)),$$

e.g. the bandpass beamform controller may be configured to determine the first bandpass coefficient and contralateral bandpass coefficient by solving this minimization problem. When the adaptation process converges, the solution is the beamforming result (first bandpass coefficient and contralateral bandpass coefficient). When adaptation process is started from equal weights, ($\alpha_0=\beta_0=0.5$), the better ear listening strategy could select the signal from minimum RMS of the three signals.

In one or more exemplary hearing devices, the bandpass beamformer comprises a bandpass equalizer configured to provide the second bandpass beamform signal based on an equalizer input, wherein the equalizer input is based on the first bandpass beamform signal and/or the contralateral bandpass beamform signal. The multi-channel selective sub-band directional filtering scheme of the present disclosure can effectively reduce the noise interferences in the selected frequency bands. However, due to the noise reduction, the total loudness of those sub-bands could be perceived as softer relatively to other bands or have more bass. A bandpass equalizer can compensate for such loss of loudness. Further, spread of masking from high low-frequency sub-band is reduced or substantially avoided. The bandpass equalizer may be activated dependent on the sound environment and/or a specific listening scenario.

In one or more exemplary hearing devices, the bandpass equalizer is configured to determine a compensation coefficient also denoted G_1 and apply the compensation coefficient to a linear combination of the first bandpass beamform signal and/or the contralateral bandpass beamform signal, optionally when there is no targeted speech detected. In one or more exemplary hearing devices, the compensation coefficient is given/computed as a scale factor $G_1$ as:

$$G_1 = \sqrt{\frac{E\{l^2\}}{E\{v^2\}}},$$

where l is the first bandpass beamform signal, v=A_1*l+B_1*r, and r is the contralateral bandpass beamform signal, i.e. the square root of the intensity ratio before and after beamforming. Thus, the beamformed band may be up-scaled to its original RMS level.

In one or more exemplary hearing devices, the unprocessed bands may be down-scaled based on the scale.

The second beamforming module may comprise a low-pass beamformer for provision of a second low-pass beamform signal, e.g. based on a first low-pass beamform signal and a contralateral low-pass beamform signal. The low-pass beamformer may be an adaptive beamformer. The adder may be connected to the low-pass beamformer for provision of a beamformed input signal based on the second low-pass beamform signal.

The low-pass beamformer may comprise a low-pass beamform controller and a first multiplier, wherein the low-pass beamformer, e.g. the low-pass beamform controller, is optionally configured to determine a first low-pass coefficient for the first low-pass beamform signal based on the first low-pass beamform signal and/or the contralateral low-pass beamform signal. The low-pass beamformer, e.g. the low-pass beamform controller, is optionally configured to apply the first low-pass coefficient in the first multiplier.

The hearing device, e.g. the low-pass beamform controller, may be configured to determine a first low-pass coefficient also denoted A_2 for the first low-pass beamform signal. For example, to determine a first low-pass coefficient for the first low-pass beamform signal may comprise to solve a minimization problem. The minimization problem may be based on expected power values of the first low-pass beamform signal and/or the contralateral low-pass beamform signal.

In one or more exemplary hearing devices, the low-pass beamformer comprises a contralateral multiplier. The low-pass beamform controller may be configured to determine a contralateral low-pass coefficient also denoted B_2 for the contralateral low-pass beamform signal based on the first low-pass beamform signal and/or the contralateral low-pass beamform signal. The low-pass beamform controller may be configured to apply the contralateral low-pass coefficient in the contralateral multiplier, e.g. to the contralateral low-pass beamform signal.

The second beamforming module may comprise a high-pass beamformer for provision of a second high-pass beamform signal, e.g. based on a first high-pass beamform signal and a contralateral high-pass beamform signal. The high-pass beamformer may be an adaptive beamformer. The adder may be connected to the high-pass beamformer for provision of a beamformed input signal based on the second high-pass beamform signal.

The high-pass beamformer may comprise a high-pass beamform controller and a first multiplier, wherein the high-pass beamformer, e.g. the high-pass beamform controller, is optionally configured to determine a first high-pass coefficient for the first high-pass beamform signal based on the first high-pass beamform signal and/or the contralateral high-pass beamform signal. The high-pass beamformer, e.g. the high-pass beamform controller, is optionally configured to apply the first high-pass coefficient in the first multiplier.

The hearing device, e.g. the high-pass beamform controller, may be configured to determine a first high-pass coefficient also denoted A_3 for the first high-pass beamform signal. For example, to determine a first high-pass coefficient for the first high-pass beamform signal may comprise to solve a minimization problem. The minimization problem may be based on expected power values of the first high-pass beamform signal and/or the contralateral low-pass beamform signal.

In one or more exemplary hearing devices, the high-pass beamformer comprises a contralateral multiplier. The high-pass beamform controller may be configured to determine a contralateral high-pass coefficient also denoted B_3 for the contralateral high-pass beamform signal based on the first high-pass beamform signal and/or the contralateral high-pass beamform signal. The high-pass beamform controller may be configured to apply the contralateral high-pass coefficient in the contralateral multiplier, e.g. to the contralateral high-pass beamform signal.

The second beamforming module may comprise a plurality of bandpass beamformers for provision of a plurality of second bandpass beamform signals. Thus, a further improved SNR may be obtained in different frequency bands.

The second beamforming module may comprise a secondary bandpass beamformer for provision of a second secondary bandpass beamform signal, e.g. based on a first secondary bandpass beamform signal and a contralateral secondary bandpass beamform signal. The secondary bandpass beamformer may be an adaptive beamformer. The adder may be connected to the secondary bandpass beamformer for provision of a beamformed input signal based on the second secondary bandpass beamform signal.

The secondary bandpass beamformer may comprise a secondary bandpass beamform controller and a first multiplier, wherein the secondary bandpass beamformer, e.g. the secondary bandpass beamform controller, is optionally configured to determine a first secondary bandpass coefficient for the first secondary bandpass beamform signal based on the first secondary bandpass beamform signal and/or the contralateral secondary bandpass beamform signal. The secondary bandpass beamformer, e.g. the secondary bandpass beamform controller, is optionally configured to apply the first secondary bandpass coefficient in the first multiplier.

The hearing device, e.g. the secondary bandpass beamform controller, may be configured to determine a first secondary bandpass coefficient also denoted A_4 for the first secondary bandpass beamform signal. For example, to determine a first secondary bandpass coefficient for the first secondary bandpass beamform signal may comprise to solve a minimization problem. The minimization problem may be based on expected power values of the first secondary bandpass beamform signal and/or the contralateral secondary bandpass beamform signal.

In one or more exemplary hearing devices, the secondary bandpass beamformer comprises a contralateral multiplier. The secondary bandpass beamform controller may be configured to determine a contralateral secondary bandpass coefficient also denoted B_4 for the contralateral secondary bandpass beamform signal based on the first secondary bandpass beamform signal and/or the contralateral secondary bandpass beamform signal. The secondary bandpass beamform controller may be configured to apply the contralateral secondary bandpass coefficient in the contralateral multiplier, e.g. to the contralateral secondary bandpass beamform signal.

In one or more hearing devices with a secondary bandpass beamformer, the filter bank optionally comprises respective first and contralateral secondary bandpass filters for provision of respective first secondary bandpass beamform signal and contralateral secondary bandpass beamform signal. A lower cutoff frequency of first and contralateral secondary bandpass filters may correspond to the higher cutoff frequency of first and contralateral bandpass filters, e.g. in the range from 2 kHz to 4 kHz, and a higher cutoff frequency of first and contralateral secondary bandpass filters may correspond to the cutoff frequency of first and contralateral high-pass filters, e.g. in the range from 5.0 kHz to 7.0 kHz.

The hearing device may comprise a beamform controller connected to the second beamforming module for controlling the second beamforming module, wherein the beamforming controller is configured to apply, in the second beamforming module, a second primary beamforming scheme in a primary operating mode of the hearing device, and optionally to apply, in the second beamforming module, a second secondary beamforming scheme in a secondary operating mode of the hearing device.

The beamform controller may be connected to the first beamforming module for controlling the first beamforming module. The beamforming controller may be configured to apply, in the first beamforming module, a first primary beamforming scheme in a primary operating mode of the hearing device, and optionally to apply a first secondary beamforming scheme in a secondary operating mode of the hearing device.

The first beamforming module may be connected to the transceiver module, e.g. for feeding the first beamform signal to the transceiver module. The transceiver module may be configured for transmitting at least a part of the first beamform signal to the contralateral hearing device. The first microphone and/or the second microphone may be connected to the transceiver module, e.g. for feeding the first microphone input signal and/or the second microphone input signal to the transceiver module. The transceiver module may be configured for transmitting at least a part of the first microphone input signal and/or the second microphone input signal to the contralateral hearing device.

The method comprises obtaining a contralateral beamform signal from the contralateral hearing device, e.g. with transceiver module of the hearing device.

The method comprises obtaining a first microphone input signal and a second microphone input signal, e.g. with respective first microphone and second microphone of the hearing device. The method comprises providing a first beamform signal based on the first microphone input signal and the second microphone input signal, e.g. with first beamforming module of the hearing device. The method comprises filtering the first beamform signal and/or the contralateral beamform signal to provide a first bandpass beamform signal and a contralateral bandpass beamform signal, e.g. with filter of the hearing device. The method comprises providing a second bandpass beamform signal based on the first bandpass beamform signal and the contralateral bandpass beamform signal, e.g. with second beamforming module of the hearing device. Providing a second bandpass beamform signal optionally comprises applying adaptive beamforming to the first bandpass beamform signal and the contralateral bandpass beamform signal. The method comprises providing a beamformed input signal based on the second bandpass beamform signal, e.g. with adder of the hearing device. The method comprises performing hearing compensation processing on the beamformed input signal to provide an electrical output signal, e.g. with processor of the hearing device. The method comprises converting the electrical output signal to an audio output signal, e.g. with receiver of the hearing device.

The present hearing devices and methods uses a binaural auditory steering strategy (BASS) in aiding hearing device designers to integrate acoustical filtering, peripheral processing, and central listening level. The present disclosure intends to preserve the spatial cues in the two audio streams for spatial unmasking benefits.

FIG. 1 illustrates an exemplary hearing device. The hearing device 2 is configured for use in a binaural hearing system comprising the hearing device and a contralateral hearing device. The hearing device 2 (left/right) hearing device of binaural hearing system) comprises a transceiver module 4 for (wireless) communication with the contralateral (right/left) hearing device (not shown in FIG. 1) of the binaural system. The transceiver module 4 comprises antenna 4A and transceiver 4B, and is configured for provision of contralateral beamform signal 5 received from the distal hearing device. The hearing device 2 comprises a set of microphones comprising a first microphone 6 and a second microphone 8 for provision of a first microphone input signal 6A and a second microphone input signal 8A, respectively. The hearing device 2 comprises a first beamforming module 10 connected to the first microphone 6 and the second microphone 8 for receiving and processing the first microphone input signal 6A and the second microphone input signal 8A. The first beamforming module 10 provides or outputs a first beamform signal 10A based on the first microphone input signal 6A and the second microphone input signal 8A.

The hearing device 2 comprises a filter bank 12 connected to the first beamforming module 10. The filter bank is configured for filtering the first beamform signal 10A into a plurality of first sub-band beamform signals including a first bandpass beamform signal 12A. The filter bank 12 is optionally connected to the transceiver module 4 and configured for filtering the contralateral beamform signal 5 into a contralateral bandpass beamform signal 14A.

The hearing device 2 comprises a second beamforming module 16 connected to the filter bank 12, the second beamforming module 16 comprising an adaptive bandpass beamformer 17A for provision of a second bandpass beamform signal 18A based on the first bandpass beamform signal 12A and the contralateral bandpass beamform signal 14A. The hearing device 2 comprises an adder 20 connected to the bandpass beamformer 17A and configured for provision of a beamformed input signal 22 based on the second bandpass beamform signal 18A. Further, the adder 20 is connected to the filter bank 12 for provision of a beamformed input signal 22 based on first low-pass beamform signal 12B and/or first high-pass beamform signal 12C. Thus, a second beamforming is not performed at low and high frequencies in order to maintain ITD and ILD of first beamform signals in the binaural hearing system.

The hearing device 2 comprises a processor 24 for processing the beamformed input signal 22 and providing an electrical output signal 26 based on the beamformed input signal 22, and a receiver 28 for converting the electrical output signal 26 to an audio output signal.

Figure 2:
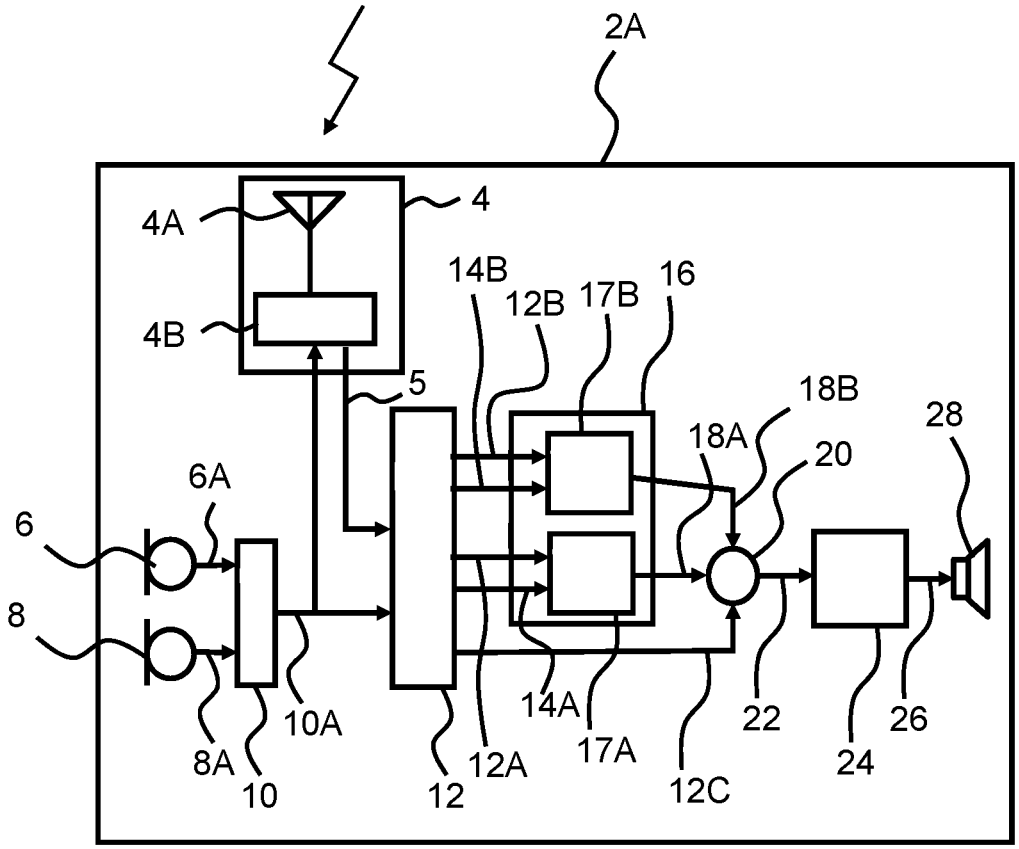
FIG. 2. schematically illustrates an exemplary hearing device.

FIG. 2 shows an exemplary hearing device 2A configured for use in a binaural hearing system comprising the hearing device and a contralateral hearing device. The hearing device 2A (left/right) hearing device of binaural hearing system) comprises a transceiver module 4 for (wireless) communication with the contralateral (right/left) hearing device (not shown in FIG. 2) of the binaural system. The transceiver module 4 is configured for provision of contralateral beamform signal 5 received from the distal hearing device. The hearing device 2A comprises a set of microphones comprising a first microphone 6 and a second microphone 8 for provision of a first microphone input signal 6A and a second microphone input signal 8A, respectively. The hearing device 2A comprises a first beamforming module 10 connected to the first microphone 6 and the second microphone 8 for receiving and processing the first microphone input signal 6A and the second microphone input signal 8A. The first beamforming module 10 provides or outputs a first beamform signal 10A based on the first microphone input signal 6A and the second microphone input signal 8A.

The hearing device 2A comprises a filter bank 12 connected to the first beamforming module 10. The filter bank is configured for filtering the first beamform signal 10A into a plurality of first sub-band beamform signals including a first bandpass beamform signal 12A and a first low-pass beamform signal 12B. The filter bank 12 is optionally connected to the transceiver module 4 and configured for filtering the contralateral beamform signal 5 into a contralateral bandpass beamform signal 14A and a contralateral low-pass beamform signal 14B.

The hearing device 2A comprises a second beamforming module 16 connected to the filter bank 12, the second beamforming module 16 comprising an adaptive bandpass beamformer 17A for provision of a second bandpass beamform signal 18A based on the first bandpass beamform signal 12A and the contralateral bandpass beamform signal 14A. The second beamforming module 16 comprises an adaptive low-pass beamformer 17B for provision of a second low-pass beamform signal 18B based on the first low-pass beamform signal 12B and the contralateral low-pass beamform signal 14B. The hearing device 2A comprises an adder 20 connected to the bandpass beamformer 17A and the low-pass beamformer 17B. The adder 20 is configured for provision of a beamformed input signal 22 based on the second bandpass beamform signal 18A and the second low-pass beamform signal. Further, the adder 20 is connected to the filter bank 12 for provision of the beamformed input signal 22 based on first high-pass beamform signal 12C. Thus, a second beamforming is not performed at high frequencies in order to maintain ILD of first beamform signals in the binaural hearing system.

The hearing device 2A comprises a processor 24 for processing the beamformed input signal 22 and providing an electrical output signal 26 based on the beamformed input signal 22, and a receiver 28 for converting the electrical output signal 26 to an audio output signal.

Figure 3:
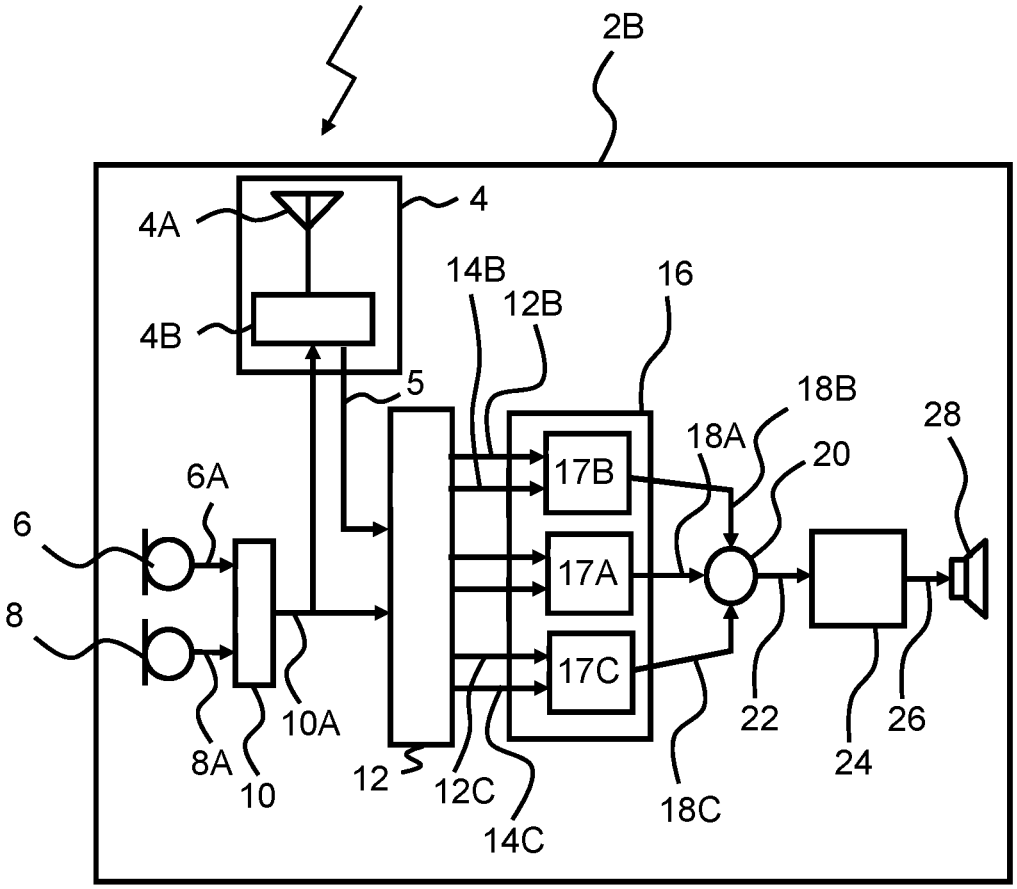
FIG. 3 schematically illustrates an exemplary hearing device.

FIG. 3 shows an exemplary hearing device 2B configured for use in a binaural hearing system comprising the hearing device and a contralateral hearing device. The hearing device 2B (left/right) hearing device of binaural hearing system) comprises a transceiver module 4 for (wireless) communication with the contralateral (right/left) hearing device (not shown in FIG. 3) of the binaural system. The transceiver module 4 is configured for provision of contralateral beamform signal 5 received from the distal hearing device. The hearing device 2B comprises a set of microphones comprising a first microphone 6 and a second microphone 8 for provision of a first microphone input signal 6A and a second microphone input signal 8A, respectively. The hearing device 2B comprises a first beamforming module 10 connected to the first microphone 6 and the second microphone 8 for receiving and processing the first microphone input signal 6A and the second microphone input signal 8A. The first beamforming module 10 provides or outputs a first beamform signal 10A based on the first microphone input signal 6A and the second microphone input signal 8A.

The hearing device 2B comprises a filter bank 12 connected to the first beamforming module 10. The filter bank is configured for filtering the first beamform signal 10A into a plurality of first sub-band beamform signals including a first bandpass beamform signal 12A, a first low-pass beamform signal 12B, and a first high-pass beamform signal 12C. The filter bank 12 is optionally connected to the transceiver module 4 and configured for filtering the contralateral beamform signal 5 into a contralateral bandpass beamform signal 14A, a contralateral low-pass beamform signal 14B, and a contralateral high-pass beamform signal 14C. Filtering the contralateral beamform signal into contralateral sub-band beamform signals 14A, 14B, 14C improves the design flexibility by enabling sub-band beamforming based on contralateral sub-band beamform signals.

The hearing device 2B comprises a second beamforming module 16 connected to the filter bank 12, the second beamforming module 16 comprising an adaptive bandpass beamformer 17A for provision of a second bandpass beamform signal 18A based on the first bandpass beamform signal 12A and the contralateral bandpass beamform signal 14A. The second beamforming module 16 comprises an adaptive low-pass beamformer 17B for provision of a second low-pass beamform signal 18B based on the first low-pass beamform signal 12B and the contralateral low-pass beamform signal 14B. The second beamforming module 16 comprises an adaptive high-pass beamformer 17C for provision of a second high-pass beamform signal 18C based on the first high-pass beamform signal 12C and the contralateral high-pass beamform signal 14C. The hearing device 2B comprises an adder 20 connected to the bandpass beamformer 17A, the high-pass beamformer 17C, and, if present, the low-pass beamformer 17B. The adder 20 is configured for provision of a beamformed input signal 22 based on the second bandpass beamform signal 18A, the second high-pass beamform signal 18C, and the second low-pass beamform signal 18B. In an exemplary hearing device similar to hearing device 2B, the low-pass beamformer 17B may be omitted, and the first low-pass beamform signal 12B may be fed directly to the adder 20. The hearing device 2 comprises a processor 24 for processing the beamformed input signal 22 and providing an electrical output signal 26 based on the beamformed input signal 22, and a receiver 28 for converting the electrical output signal 26 to an audio output signal.

Figure 4:
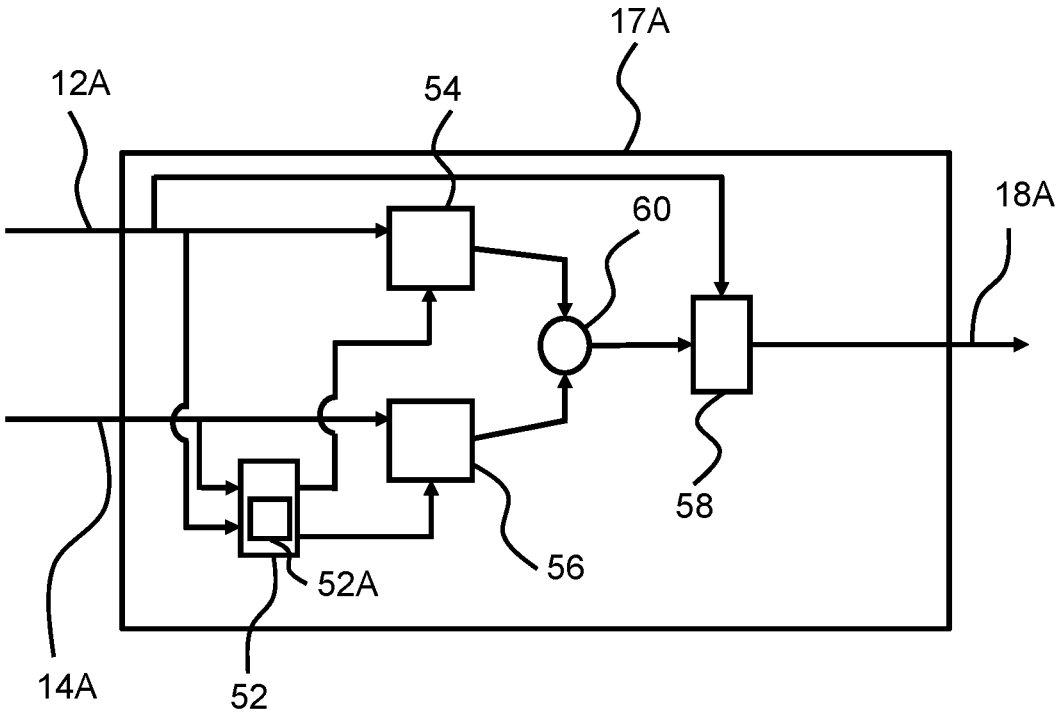
FIG. 4 shows an exemplary bandpass beamformer of the second beamforming module.

FIG. 4 shows an exemplary bandpass beamformer 17A of the second beamforming module 16. The bandpass beamformer comprises a bandpass beamform controller 52 and a first multiplier 54, wherein the bandpass beamformer is configured to determine a first bandpass coefficient A_1 for the first bandpass beamform signal 12A based on the first bandpass beamform signal 12A and the contralateral bandpass beamform signal 14A. The bandpass beamform controller 52 is configured to apply the first bandpass coefficient A_1 to the first bandpass beamform signal 12A in the first multiplier 54, e.g. by sending the first bandpass coefficient or a first control signal indicative of the first bandpass coefficient to the first multiplier 54. The bandpass beamformer 17A comprises a contralateral multiplier 56, and the bandpass beamform controller 52 is configured to determine a contralateral bandpass coefficient B_1 for the contralateral bandpass beamform signal 14A based on the first bandpass beamform signal 12A and the contralateral bandpass beamform signal 14A. The bandpass beamform controller 52 is configured to apply the contralateral bandpass coefficient B_1 in the contralateral multiplier 56, e.g. by sending the contralateral bandpass coefficient B_1 or a contralateral control signal indicative of the contralateral bandpass coefficient B_1 to the contralateral multiplier 56. The bandpass beamformer 17A comprises an adder 60 connected to multipliers 54, 56 for adding the output signals of respective multipliers 54, 56. The bandpass beamformer 17A comprises a bandpass equalizer 58 connected to the adder 60 and configured to provide the second bandpass beamform signal 18A based on an equalizer input being the output signal of adder 60. Thus, the equalizer input is based on the first bandpass beamform signal and/or the contralateral bandpass beamform signal, depending on the present value of coefficients A_1 and B_1. The bandpass equalizer 58 is configured to determine a compensation coefficient also denoted G_1 and apply the compensation coefficient to the output of the adder being a linear combination of the first bandpass beamform signal 12A and/or the contralateral bandpass beamform signal 14A. The compensation coefficient is optionally determined as:

$$G_1 = \sqrt{\frac{E\{l^2\}}{E\{v^2\}}},$$

where l is the first bandpass beamform signal 12A, v=A_1*l+B_1*r, and r is the contralateral bandpass beamform signal 14A. Thus, the compensation coefficient is the square root of the intensity ratio before and after beamforming and the bandpass sub-band is up-scaled to its original RMS level.

The bandpass beamform controller 52 is configured to determine, e.g. with determiner 52A, first bandpass coefficient A_1 and contralateral bandpass coefficient B_1 by solving a minimization problem given by cost function C and constraint as described above using the stochastic steepest descent algorithm.

Thus, in the bandpass beamformer 17A, the second bandpass beamform signal 18A also denoted X_1 is given by:

$$X_1 = G_1 * (A_1 * l + B_1 * r);$$

where l is the first bandpass beamform signal 12A and r is the contralateral bandpass beamform signal 14A.

Figure 5:
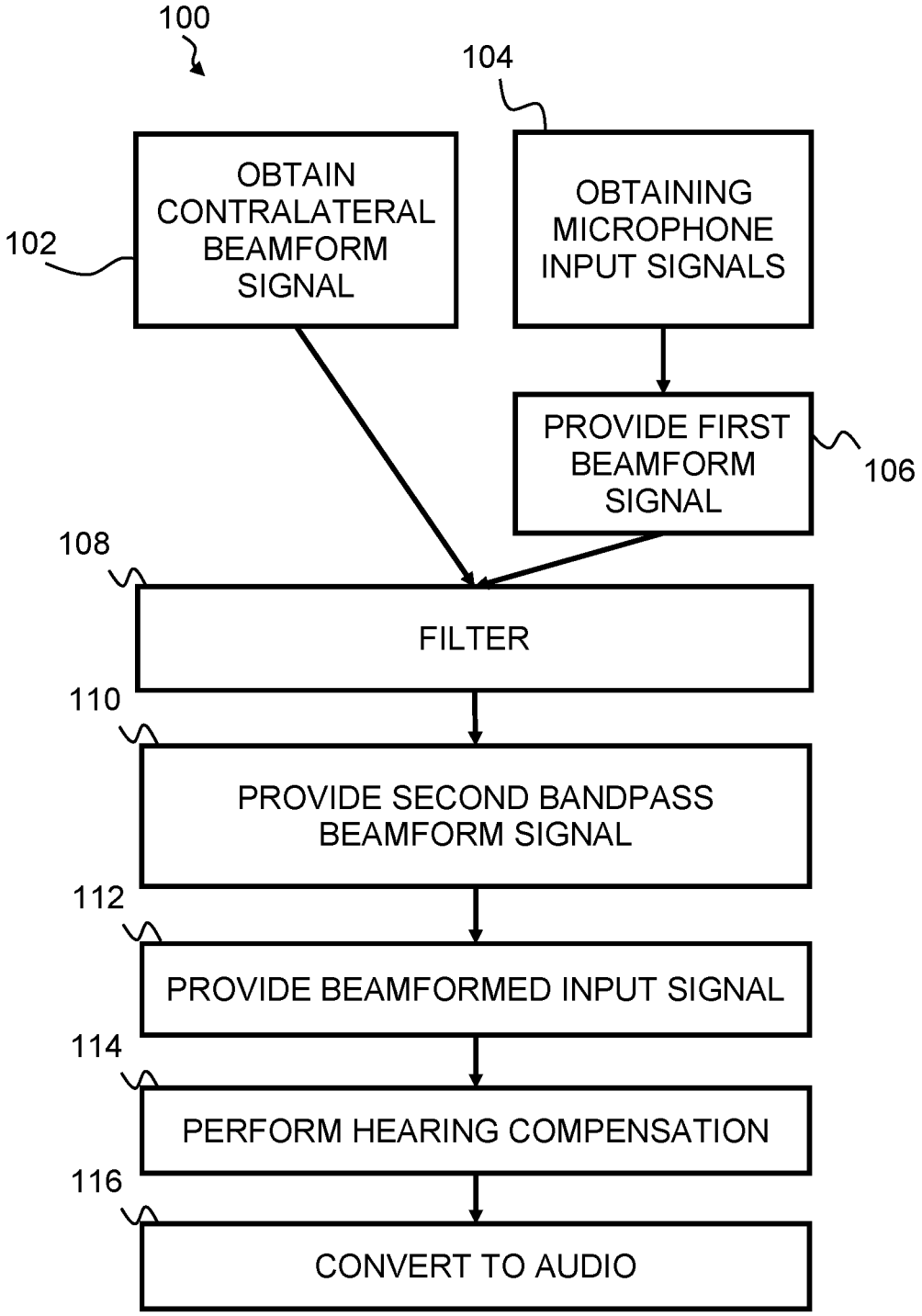
FIG. 5 is a flow diagram of an exemplary method.

FIG. 5 is a flowchart of an exemplary method 100 of operating a hearing device in a binaural hearing system comprising the hearing device and a contralateral hearing device. The method 100 comprises obtaining 102 a contralateral beamform signal from the contralateral hearing device and obtaining 104 a first microphone input signal and a second microphone input signal. Further, the method 100 comprises providing 106 a first beamform signal based on the first microphone input signal and the second microphone input signal and filtering 108 the first beamform signal and the contralateral beamform signal to provide a first bandpass beamform signal and a contralateral bandpass beamform signal. The method proceeds to providing 110 a second bandpass beamform signal based on the first bandpass beamform signal and the contralateral bandpass beamform signal, wherein providing 110 a second bandpass beamform signal comprises applying adaptive beamforming to the first bandpass beamform signal and the contralateral bandpass beamform signal. The method 100 comprises providing 112 a beamformed input signal based on the second bandpass beamform signal, performing 114 hearing compensation processing on the beamformed input signal to provide an electrical output signal, and converting 116 the electrical output signal to an audio output signal.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 transceiver module
4A antenna
4B transceiver/radio unit
5 contralateral beamform signal
6 first microphone
6A first microphone input signal
8 second microphone
8A second microphone input signal
10 first beamforming module
10A first beamform signal
12 filter bank
12A first bandpass beamform signal
12B first low-pass beamform signal
12C first high-pass beamform signal
14A contralateral bandpass beamform signal
14B contralateral low-pass beamform signal
14C contralateral high-pass beamform signal
16 second beamforming module
17A bandpass beamformer
17B low-pass beamformer
17C high-pass beamformer
18A second bandpass beamform signal
18B second low-pass beamform signal
18C second high-pass beamform signal
20 adder
22 beamformed input signal
24 a processor
26 electrical output signal
28 receiver
52 bandpass beamform controller
54 first multiplier
56 contralateral multiplier
58 bandpass equalizer

60 adder
100 method of operating a hearing device
102 obtain contralateral beamform signal
104 obtain first microphone input signal and second microphone input signal
106 provide first beamform signal
108 filter first beamform signal and contralateral beamform signal
110 provide second bandpass beamform signal
112 provide beamformed input signal
114 perform hearing compensation processing
116 convert electrical output signal to audio output signal

The invention claimed is:

1. A hearing device for a binaural hearing system comprising the hearing device and a contralateral hearing device, the hearing device comprising:

a transceiver module for communication with a contralateral hearing device of the binaural hearing system, the transceiver module configured to obtain a contralateral filtered beamform signal from the contralateral hearing device;

a set of microphones comprising a first microphone for provision of a first microphone input signal, and a second microphone for provision of a second microphone input signal;

a first beamforming module, connected to the set of microphones, for provision of a first beamform signal based on the first microphone input signal and the second microphone input signal;

a filter bank, connected to the first beamforming module, for filtering the first beamform signal into a plurality of filtered beamform signals including a first bandpass beamform signal;

a bandpass beamformer coupled to the filter bank, wherein the bandpass beamformer is configured to provide a second bandpass beamform signal based at least in part on the contralateral filtered beamform signal;

an adder, connected to the bandpass beamformer, for provision of a beamformed input signal;

a processing circuit for processing the beamformed input signal and providing an electrical output signal based on the beamformed input signal; and a receiver for converting the electrical output signal to an audio output signal;

wherein the processing circuit is coupled downstream with respect to the adder.

2. The hearing device according to claim 1, wherein the bandpass beamformer comprises a bandpass beamform controller and a first multiplier, wherein the bandpass beamformer is configured to determine a first bandpass coefficient for the first bandpass beamform signal, and to apply the first bandpass coefficient in the first multiplier.

3. The hearing device according to claim 2, wherein the bandpass beamformer is configured to determine the first bandpass coefficient for the first bandpass beamform signal by solving a minimization problem.

4. The hearing device according to claim 2, wherein the bandpass beamformer is configured to determine the first bandpass coefficient for the first bandpass beamform signal by solving a minimization problem based on an expected mean square value of a linear combination of the first bandpass beamform signal and the contralateral filtered beamform signal.

5. The hearing device according to claim 2, wherein the bandpass beamformer comprises a contralateral multiplier, and wherein the bandpass beamform controller is configured to determine a contralateral bandpass coefficient for the contralateral filtered beamform signal, and to apply the contralateral bandpass coefficient in the contralateral multiplier.

6. The hearing device according to claim 1, further comprising a bandpass beamform controller configured to determine the contralateral bandpass coefficient for the contralateral bandpass beamform signal by solving a minimization problem based on expected power values of the first bandpass beamform signal and the contralateral filtered beamform signal.

7. The hearing device according to claim 1, further comprising a bandpass beamform controller configured to determine the contralateral bandpass coefficient for the contralateral bandpass beamform signal by solving a minimization problem based on an expected mean square value of a linear combination of the first bandpass beamform signal and the contralateral filtered beamform signal.

8. The hearing device according to claim 1, wherein the bandpass beamformer comprises a bandpass equalizer.

9. The hearing device according to claim 1, wherein the bandpass beamformer comprises a low-pass beamformer.

10. The hearing device according to claim 1, wherein the bandpass beamformer comprises a high-pass beamformer.

11. The hearing device according to claim 1, wherein the hearing device comprises a beamform controller connected to the bandpass beamformer for controlling the bandpass beamformer.

12. The hearing device according to claim 11, wherein the beamform controller is connected to the first beamforming module for controlling the first beamforming module.

13. The hearing device according to claim 1, wherein the transceiver module is configured for transmitting at least a part of a filtered first beamform signal to the contralateral hearing device.

14. The hearing device according to claim 1, wherein the first beamforming module is configured to operate in time domain.

15. The hearing device according to claim 1, wherein the bandpass beamformer is configured to operate in time domain.

16. The hearing device according to claim 1, wherein the bandpass beamformer is an adaptive beamformer.

17. The hearing device according to claim 1, wherein the adder is configured to receive the second bandpass beamform signal from the bandpass beamformer, and the first bandpass beamform signal from the filter bank.

18. The hearing device according to claim 17, wherein the first bandpass beamform signal comprises a low-pass beamform signal.

19. The hearing device according to claim 17, wherein the first bandpass beamform signal comprises a high-pass beamform signal.

20. A binaural hearing system comprising the hearing device according to claim 1, and a contralateral hearing device.

21. A method of operating a hearing device in a binaural hearing system comprising the hearing device and a contralateral hearing device, the method comprising:

obtaining a contralateral filtered beamform signal from the contralateral hearing device;

obtaining a first microphone input signal and a second microphone input signal;

providing a first beamform signal based on the first microphone input signal and the second microphone input signal;

filtering, by a filter bank, the first beamform signal to provide a first bandpass beamform signal;

providing a second bandpass beamform signal by a bandpass beamformer that is coupled to the filter bank, wherein the second bandpass beamform signal is provided based at least in part on the contralateral filtered bandpass beamform signal;

providing, by an adder, a beamformed input signal, wherein the adder is coupled to the bandpass beamformer;

performing, by a processing circuit, hearing compensation processing on the beamformed input signal to provide an electrical output signal; and converting the electrical output signal to an audio output signal;

wherein the processing circuit is located downstream with respect to the adder.

22. The method according to claim 21, wherein the act of providing the second bandpass beamform signal comprises applying beamforming to the contralateral filtered beamform signal.

23. The method according to claim 22, wherein the act of applying beamforming to the contralateral filtered beamform signal comprises applying adaptive beamforming to the contralateral filtered beamform signal.

24. The method according to claim 21, wherein the adder is configured to receive the second bandpass beamform signal from the bandpass beamformer, and a low-pass beamform signal from the filter bank.

25. The method according to claim 21, wherein the adder is configured to receive the second bandpass beamform signal from the bandpass beamformer, and a high-pass beamform signal from the filter bank.

26. The method according to claim 21, further comprising receiving, by the adder, the second bandpass beamform signal from the bandpass beamformer, and the first bandpass beamform signal from the filter bank.

27. The method according to claim 26, wherein the first bandpass beamform signal comprises a low-pass beamform signal.

28. The method according to claim 26, wherein the first bandpass beamform signal comprises a high-pass beamform signal.

* * * * *